US006435383B1

(12) United States Patent
Lee

(10) Patent No.: US 6,435,383 B1
(45) Date of Patent: Aug. 20, 2002

(54) SPOUT ASSEMBLY FOR LIQUID CONTAINER

(76) Inventor: Jung-Min Lee, 705, Hosan Plaza, Apt. 37 Samsung-dong, Kamgnam-gu, Seoul (KR)

( * ) Notice: Subject to any disclaimer, the term of this patent is extended or adjusted under 35 U.S.C. 154(b) by 0 days.

(21) Appl. No.: 09/743,735

(22) PCT Filed: Jul. 15, 1999

(86) PCT No.: PCT/KR99/00377

§ 371 (c)(1),
(2), (4) Date: Mar. 20, 2001

(87) PCT Pub. No.: WO00/03921

PCT Pub. Date: Jan. 27, 2000

(30) Foreign Application Priority Data

| | | |
|---|---|---|
| Jul. 15, 1998 | (KR) | 98/29349 |
| Dec. 28, 1998 | (KR) | 98-63947 |
| Mar. 15, 1999 | (KR) | 99-9283 |
| Apr. 13, 1999 | (KR) | 99-13636 |
| Apr. 24, 1999 | (KR) | 99-15732 |

(51) Int. Cl.[7] ..... B67D 3/00
(52) U.S. Cl. ..... 222/522; 222/464.3; 222/525
(58) Field of Search ..... 222/522, 499, 222/211, 464.3, 464.2, 525

(56) References Cited

U.S. PATENT DOCUMENTS

| | | | | | |
|---|---|---|---|---|---|
| 3,305,127 | A | * | 2/1967 | Baranne | 220/39 |
| 4,718,778 | A | * | 1/1988 | Ichikawa | 383/100 |
| 5,494,196 | A | * | 2/1996 | Tyner | 222/147 |
| 5,607,086 | A | * | 3/1997 | Gooch | 222/525 |
| 5,842,076 | A | * | 11/1998 | Glover | 396/626 |

* cited by examiner

*Primary Examiner*—Henry C. Yuen
*Assistant Examiner*—Melvin A. Cartagena
(74) *Attorney, Agent, or Firm*—Artz & Artz, P.C.

(57) ABSTRACT

A spout assembly for a liquid container including: a body coupled to the container and centrally provided with a vertical passage, the body including a cap coupling portion, a thread formed a round the cap coupling portion, and a skirt engagement member formed at a lower end of the cap coupling portion; a spout slidably inserted into the vertical passage of the body, the spout including an elongated tube member slidably inserted into the vertical passage of the body, a lower annular protrusion protruded from the elongated tube member and adapted to be selectively fitted in the annular groove of the body, at least one through hole radially perforated through the tube member, the through hole being closed by an inner surface of the body defining the vertical passage when the lower annular protrusion is fitted in the annular groove of the body, an annular cap engagement protrusion formed lot at an upper end of the tube member, an upper annular protrusion formed at the tube member while being vertically spaced from the annular cap engagement protrusion to define an annular groove, and a liquid passage defined in the rube member; and a cap threadedly coupled to the cap coupling portion of the body, the cap including a cap body, an annular groove formed at an inner surface of a top wall of the cap body, the annular groove being engageable with the annular cap engagement protrusion of the tube member, an annular protrusion formed at an inner surface of a side wall of the cap body, the annular protrusion being engageable with the annular groove of the rube member, and a thread formed on the inner surface of the cap body beneath the annular contact surface and adapted to be engageable with the thread of the body.

15 Claims, 17 Drawing Sheets

SPOUT ASSEMBLY FOR LIQUID CONTAINER

TECHNICAL FIELD

The present invention relates to a spout assembly for a liquid container, and more particularly to a plastic spout assembly designed to be applied to a variety of containers, such as flexible pouches and non-flexible containers, while being capable of not only achieving an easy filling of a liquid beverage in a container, to which the spout assembly is applied, but also allowing the user to easily and conveniently drink the filled liquid beverage.

BACKGROUND ART

As is well known, there is a sealed flexible liquid, pouch. In order to form an opening, such a pouch is cut at a desired portion thereof by scissors. A liquid container is also known which is sealed at its opening by a thin film. In use of such a liquid container, a straw is pierced through the thin film. However, such actions required to open those liquid containers are troublesome.

In order to solve such a problem, a liquid container has been proposed in which a spout is provided at a portion of the liquid container where a seal is formed. The spout comprises an elongated tube extending to the interior of the liquid container. For this reason, this liquid container has a problem in that when a liquid is filled in the container, the elongated tube prevents air remaining in the interior of the container from being smoothly vented from the container, so that an air expansion occurs in the interior of the container, thereby considerably reducing the filling rate of the liquid. Furthermore, when the liquid contained in the container is dispensed into a cup in order for someone to drink the liquid, it is incompletely discharged from the container because the spout has an elongated tube structure extending to the interior of the container by a considerable length.

In order to eliminate the above drawback, another spout has been proposed which is disclosed in Korean Utility Model Publication No. 91-5740. However, this spout also has a drawback.

In this spout, a through hole is formed at a desired portion of the spout in order to allow the liquid contained in a container, to which the spout is applied, to be completely discharged therethrough. In this case, however, there is a problem after the user drinks the liquid contained in the container over a certain amount. In a state in which the liquid contained in the container is outwardly discharged over a certain amount, the user can drink the liquid sucked into the spout through the lower end of the spout after air filled in the interior of the container is outwardly discharged through the through hole. That is, the liquid from the container is outwardly discharged as the container shrinks. For this reason, a very high suction force is needed to drink the liquid contained in the container. As a result, this spout is problematic in that it is difficult for the old and the weak or children to drink the liquid contained in the container using the spout.

For instance, if the user drinks 50 ml of liquid from the container having a capacity of 500 ml, about 350 ml of air is then sucked into the container. When the user drinks again the liquid left in the container by a suction force, 350 ml of air existing in the container is first outwardly discharged from the container via the through hole. After the air existing in the container is completely vented, a further suction force generated by the user causes the through hole to be closed by a film wall of the container. As a result, a vacuum is generated in the interior of the container. For this reason, there is a problem in that the user drinks the liquid left in the container against the vacuum.

Furthermore, the spout disclosed in Korean Utility Model Publication No. 91-5740 cannot be applied to non-flexible containers, made of a material exhibiting a relatively high hardness, such as PET containers or containers made of glass or metal.

A technique for adapting a spout to a bottle cap has been proposed which is mainly used in association with drinking of beverages. However, such a technique is a simple technique for simply sucking a beverage contained in a container in order to allow the user to drink the beverage. For example, U.S. Pat. No. 5,803,310 diploses a bottle cap adaptable spout. Although this bottle cap adaptable spout has a certain industrial utility, it is extremely unsuitable for the drinking of beverages. Such a drawback becomes apparent by referring to FIG. 5 of U.S. Pat. No. 5,803,310.

DISCLOSURE OF THE INVENTION

The present invention has been made to provide a spout assembly having an improved configuration in view of the above mentioned problems involved in the conventional spouts.

Therefore, a first object of the invention is to provide a spout assembly having a configuration capable of being applied to any containers irrespective of the structural features of those containers, for example, the materials of those containers.

A second object of the invention is to provide a spout assembly having a configuration capable of allowing the user to not only easily drink a liquid contained in a container, to which the spout assembly is applied, but also to dispense the liquid into another container.

A third object of the invention is to provide a spout assembly having a configuration capable of preventing pneumatic pressure from being generated in a container, to which the spout assembly is applied, when a liquid is filled in the container.

A fourth object of the invention is to provide a spout assembly having a configuration capable of exhibiting a superior sealability for preventing gas saturated in a liquid contained in a container, to which the spout assembly is applied, from leaking.

A fifth object of the invention is to provide a spout assembly including a cap capable of, when the cap is separated from the spout assembly, moving a spout included in the spout assembly to a position where the spout allows the user to drink a liquid contained a container, to which the spout assembly is applied, thereby providing superior sanitation.

A sixth object of the invention is to provide a spout assembly including a cap having a screw type structure capable of allowing a spout included in the spout assembly to be raised and lowered using minimal force, thereby allowing even children to easily use the spout assembly, namely, to easily open and close the spout.

In accordance with the present invention, these objects are accomplished by providing 1. A spout assembly for a liquid container comprising: a body centrally provided with a vertical passage extending vertically throughout the body, the body including an annular groove formed at a lower end of the vertical passage, a primary container bonding portion provided at a lower portion of the body, the primary container bonding portion extending around the vertical passage while extending laterally in a reduced thickness at opposite sides of the vertical passage, a secondary container bonding portion formed at the lower portion of the body over the primary container bonding portion, the secondary container bonding portion extending laterally beyond the primary container bonding portion, a cap coupling portion provided at an upper portion of the body, a thread formed around the cap coupling portion, a skirt engagement member formed at a lower end of the cap coupling portion, and a pair of opposite alignment grooves provided at an intermediate portion of the body; a spout inserted into the vertical passage of the body in such a fashion that it is slidable along the vertical passage, the spout including an elongated tube member slidably inserted into the vertical passage of the body, a lower annular protrusion protruded from an outer surface of the elongated tube member at a desired position and adapted to be selectively fitted in the annular groove of the body, at least one through hole radially perforated through the tube member above the lower annular protrusion, the through hole being closed by an inner surface of the body defining the vertical passage when the lower annular protrusion is fitted in the annular groove of the body, an annular cap engagement protrusion formed at an upper end of the tube member, an upper annular protrusion formed at the tube member while being vertically spaced from the annular cap engagement protrusion to define an annular groove, and a liquid passage defined in the tube member, the liquid passage extending vertically throughout the tube member while communicating with the through hole; and a cap threadedly coupled to the thread of the cap coupling portion in the body, the cap including a cap body, an opening identification skirt provided at a lower end of the cap body and engaged with the skirt engagement member of the body, an annular groove formed at an inner surface of a top wall of the cap body, the annular groove being engagable with the annular cap engagement protrusion of the tube member in a snapped fashion, an annular protrusion formed at an inner surface of a side wall of the cap body, the annular protrusion being engagable with the annular groove of the tube member in a snapped fashion, an annular contact surface provided at the inner surface of the side wall of the cap body beneath the annular protrusion, the annular contact surface being in tight contact with the upper annular protrusion of the tube member in a state in which the cap engages with the tube member, and a thread formed on the inner surface of the cap body beneath the annular contact surface and adapted to be engagable with the thread of the body.

BRIEF DESCRIPTION OF THE DRAWINGS

Other objects and aspects of the invention will become apparent from the following description of embodiments with reference to the accompanying drawings in which:

FIGS. 1A to 1J illustrate a spout assembly according to a first embodiment of the present invention, in which FIG. 1A is an exploded perspective view of the spout assembly, FIG. 1B is an assembled front view of the spout assembly, FIG. 1C is a cross-sectional view of a cap included in the spout assembly, FIG. 1D is a cross-sectional view of a body included in the spout assembly, FIG. 1E is a cross-sectional view of a spout included in the spout assembly, FIG. 1F is a cross-sectional view taken along the line A—A of FIG. 1B, FIGS. 1G to 1H are cross-sectional views respectively illustrating different states of the spout assembly when the cap is rotated to raise the spout, FIG. 1I is a cross-sectional view illustrating a state in which the spout is completely raised in accordance with a rotation of the cap, so as to allow the user to suck a liquid contained in a container via the spout, and FIG. 1J is a cross-sectional view illustrating a state in which the spout is completely lowered in accordance with a depression of the spout, so as to allow the user to dispense the liquid contained in the container into another container via the spout; FIGS. 2A to 2C illustrate a spout assembly according to a second embodiment of the present invention, in which FIG. 2A is a cross-sectional view of a spout included in the spout assembly, FIG. 2B is a cross-sectional view illustrating a state of the spout assembly when the cap is rotated to raise the spout, and FIG. 2C is a front view illustrating a state in which the spout assembly is assembled to the neck of a container, the spout of the spout assembly being raised in accordance with a rotation of the cap;

FIGS. 6A to 6C illustrate a spout assembly according to a third embodiment of the present invention, in which FIG. 6A is a cross-sectional view illustrating an-assembled state of the spout assembly, FIG. 6B is a cross-sectional view illustrating a state in which a spout included in the spout assembly is raised in accordance with a rotation of a cap included in the spout assembly, and FIG. 6C is a cross-sectional view illustrating a state in which the spout is lowered in accordance with a depression of the spout, so as to allow the user to dispense the liquid contained in the container into another container via the spout.

BEST MODE FOR CARRYING OUT THE INVENTION

Figure 1A:
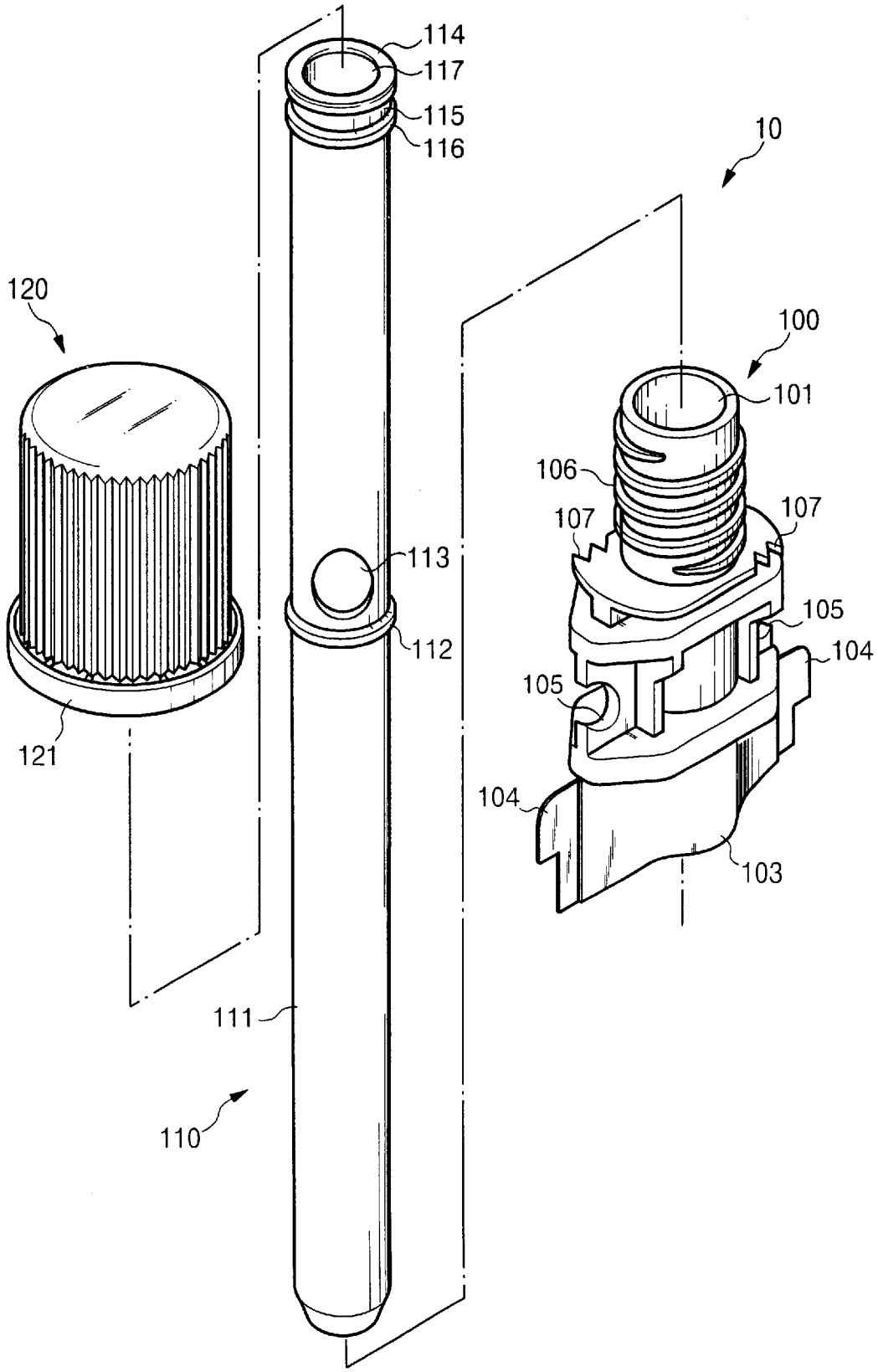

Reference will now be made in greater detail to the preferred embodiments of the present invention.

Referring to FIGS. 1A to 1J, a spout assembly according to a first embodiment of the present invention is illustrated. As shown in FIGS. 1A to 1J, the spout assembly, which is denoted by the reference numeral 10, includes a body 100, and a spout 110 inserted into the body 100 in such a fashion that it is slidable along the body 100. The spout 110 comprises an elongated tube member. A cap 120 is threadedly coupled to the body 100. In a state coupled to the body 100, the cap 120 is also engaged with an upper end of the spout 110. The body 100 is centrally provided with a vertical passage 101 extending vertically throughout the body 100 and serving to vertically receive the spout 110 while allowing the spout 110 to be slidable therealong. The vertical passage 101 has an enlarged portion 102 at its lower end. The enlarged portion 102 of the vertical passage 101 serves as an annular groove for receiving a lower annular protrusion 112 formed at a desired portion of the spout 110, thereby preventing the spout 110 from moving upwardly. The body 100 is also provided at its lower portion with a primary container bonding portion 103 extending around the vertical passage 101 while extending laterally at a reduced thickness at opposite sides of the vertical passage 101. Over the primary container bonding portion 103, a secondary container bonding portion 104 is formed which extends laterally beyond the primary container bonding portion 103. The body 100 further has a cap coupling portion 106 at its upper portion. A thread 106*a* is formed around the cap coupling portion 106. A skirt engagement member 107 is formed at the lower end of the cap coupling portion 106. A pair of opposite alignment grooves 105 are also provided at an intermediate portion of the body 100.

The spout 110 includes an elongated tube member 111 slidably inserted into the vertical passage 101 of the body 100. The lower annular protrusion 112, which is adapted to be selectively fitted in the annular groove 102 of the body 100, is protruded from the outer surface of the elongated tube member 111 at a desired position. When the tube member 111 moves upwardly through the body 100 by a predetermined length, the lower annular protrusion 112 is tightly fitted in the annular groove 102 of the body 100, thereby preventing a further upward movement of the tube member 111. Above the lower annular protrusion 112, the tube member 111 has at least one through hole 113 radially perforated through the wall of the tube member 111. In a state in which the lower annular protrusion 112 is fitted in the annular groove 102 of the body 100, the through hole 113 is closed by the inner surface of the body 100 defining the vertical passage 101. An annular cap engagement protrusion 114 is formed at the upper end of the tube member 111. Beneath the annular cap engagement protrusion 114, an upper annular protrusion 116 is formed at the tube member 111 while being vertically spaced from the annular cap engagement protrusion 114 to define an annular groove 115. When the tube member 111 moves downwardly through the body 100 by a predetermined length, the upper annular protrusion 116 comes into contact with the upper end of the body 100, thereby preventing a further downward movement of the tube member 111. A liquid passage 117 is defined in the tube member 111. The liquid passage 117 extends vertically throughout the tube member 111 while communicating with the through hole 113.

The cap 120, which is threadedly coupled to the thread 106*a* of the cap coupling portion 106 in the body 100, is provided at its lower end with an opening identification skirt 121. The opening identification skirt 121 extends radially outwardly from the lower end of the cap 120 while being connected to the lower end of the cap 120 by bridges. The opening identification skirt 121 has, at its inner surface, an engagement portion adapted to engage with the skirt engagement member 107, so that it collapses when it is subjected to a force for opening the cap 120, thereby providing a visual appearance indicative of the opening of the cap 120. The cap 120 is also provided with an annular groove 122 at the inner surface of the top wall thereof and with an annular protrusion 123 at the inner surface of the side wall thereof. The annular groove 122 is engagable with the annular cap engagement protrusion 114 of the tube member 111 in a snapped fashion, and the annular protrusion 123 is engagable with the annular groove 115 of the tube member 111 in a snapped fashion. An annular contact surface 124 is provided at the inner surface of the side wall in the cap 120 beneath the annular protrusion 123. In a state in which the cap 120 engages with the tube member 111, the annular contact surface 124 is in tight contact with the upper annular protrusion 116 of the tube member 111, thereby sealing the liquid passage 117 of the tube member 111. Beneath the annular contact surface 124, the cap 120 has a thread 125 engagable with the thread 106*a* of the body 100.

Now, the operation and effect of the spout assembly according to the first embodiment of the present invention will be described in conjunction with FIG. 1B and FIGS. 1F to 1J.

Figure 1B:
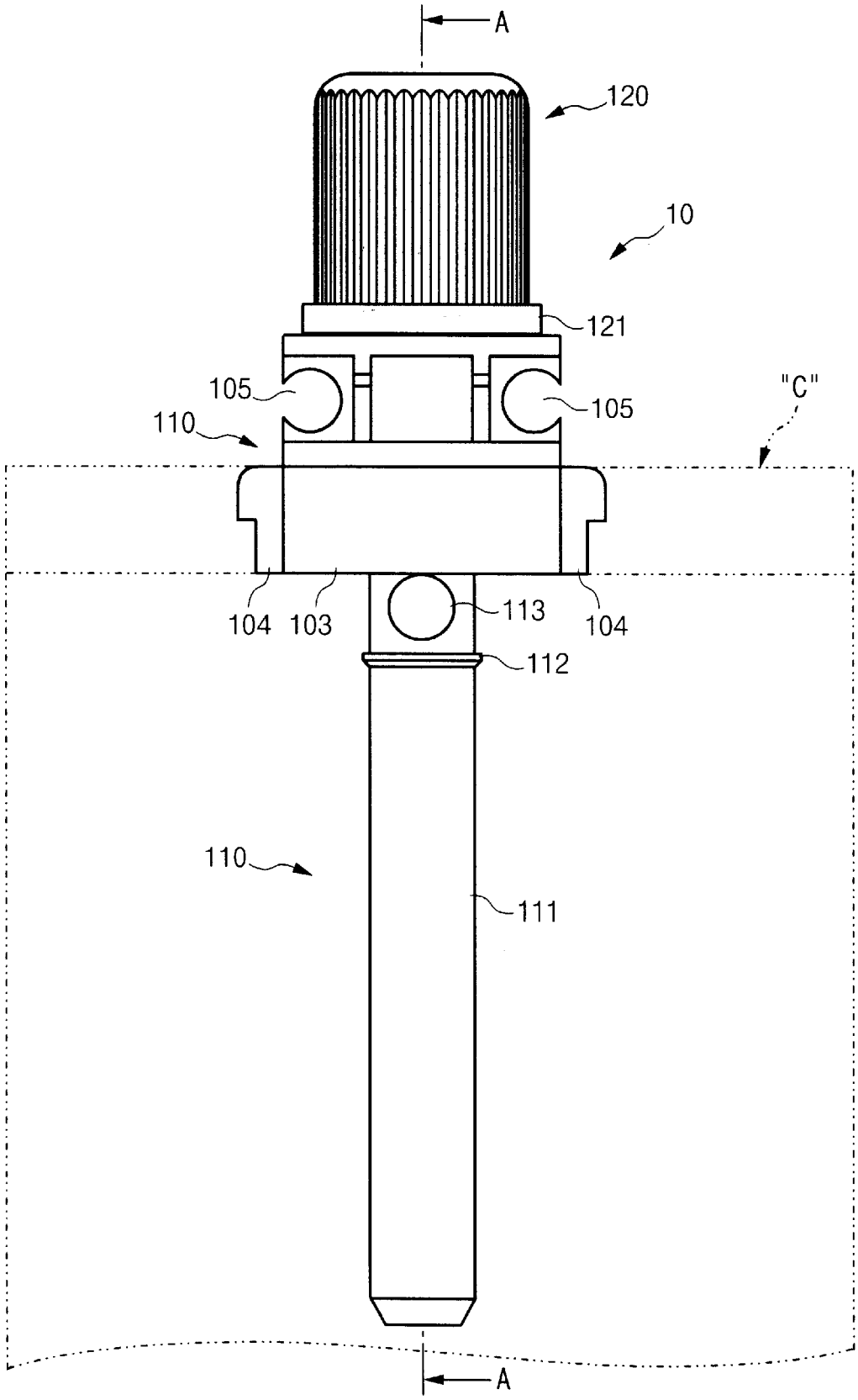
Figure 1C:
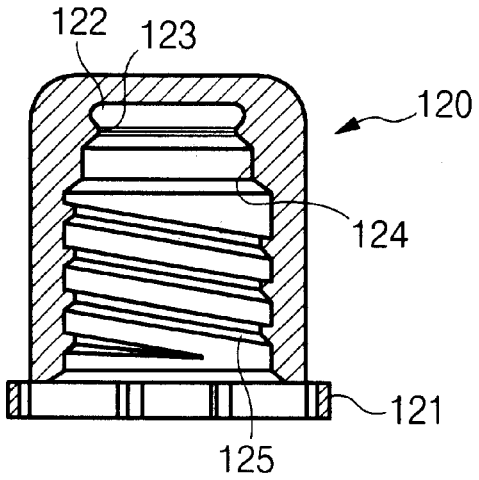
Figure 1D:
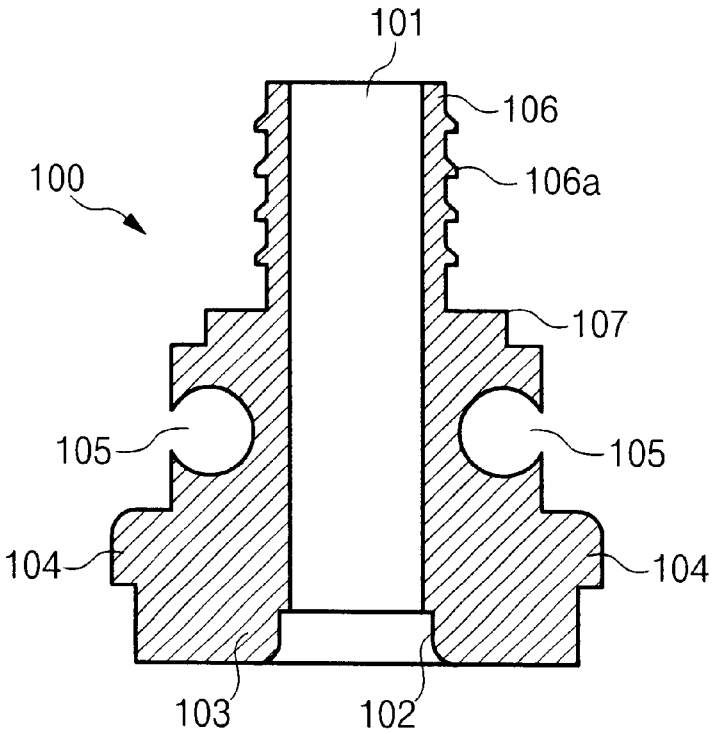
Figure 1E:
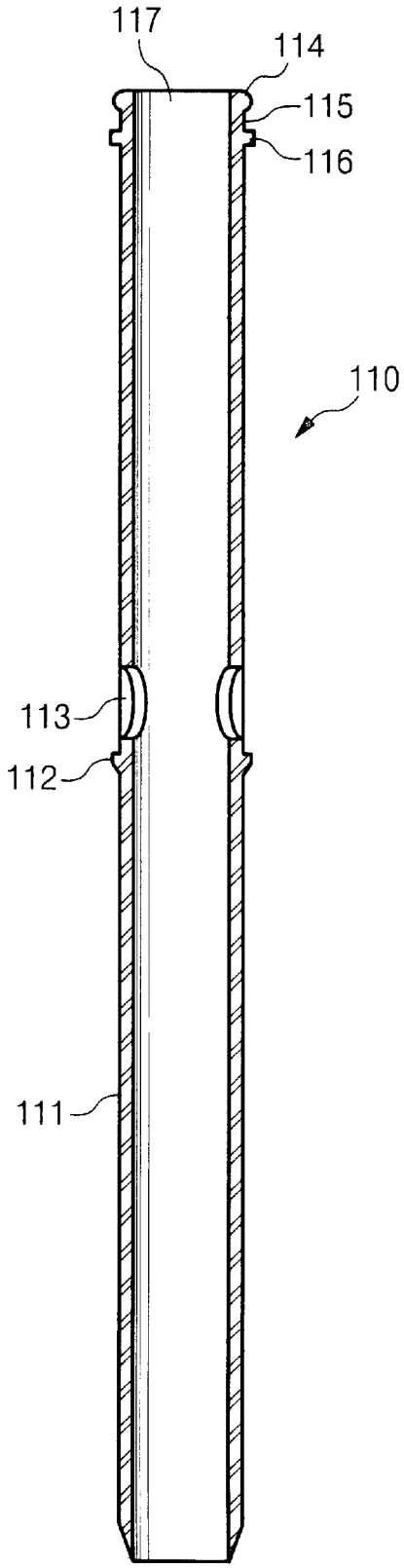

Preferably, the spout assembly 10 according to the first embodiment of the present invention is applied to a container C which comprises two sheets bonded together at their edges and made of a multilayer film (namely, a composite film) exhibiting a relatively high softness to provide a flexibility, as shown in FIG. 1B. First, the spout assembly 10 is coupled to the container C. That is, the primary and secondary bonding portions 103 and 104 of the body 100 are interposed between the upper edges of the sheets of the container C. In this state, the upper edges of the sheets are bonded together in accordance with a thermal bonding process. Thus, the primary and secondary bonding portions 103 and 104 of the body 100 are bonded to the upper edges of the sheets, so that the body 100, which carries the spout 110, is firmly coupled to the container C.

The spout assembly 10 coupled to the container C is then fed to a filling machine in order to fill a desired liquid in the container C. At this time, the spout assembly 10 is in a state in which the cap 120 has not been coupled thereto yet. In order to achieve an efficient liquid filling, a plurality of spout assemblies are simultaneously fed to the filling machine in a state in which they are held by a separate chute. Holding of the spout assemblies 10 by the chute is achieved by engaging the opposite alignment grooves 105 of each spout assembly 10 with guide pins included in the chute. Thus, the spout assemblies 10 can be stably fed to the filling machine without being separated from the chute.

After the completion of the process for filling the liquid in the container C, the spout assembly 10 coupled to the liquid-filled container C is fed to a capping machine in order to assemble the cap 120 therewith. The spout assembly 10 capped with the cap 120 is shown in FIG. 1B.

As mentioned above, the secondary bonding portion 104 of the body 100 extends laterally beyond the primary bonding portion 103. By virtue of such a structure of the secondary bonding portion 104, it is possible to minimize the area where the body 100 is not bonded to the upper edges of the container C. That is, the bondability of the body 100 can be improved.

Now, the operation and effect of the spout assembly 10 upon dispensing the liquid from the container C will be described in conjunction with FIGS. 1F to 1J. When it is desired to dispense the liquid from the container C, the cap 120 is first rotated from the state of FIG. 1F so that it is released from the spout assembly 10. By this rotation of the cap 120, the bridges of the opening identification skirt 121 collapse. Accordingly, the cap 120 can be raised in accordance with the cooperation of the threads 106*a* and 205 as it is rotated. At this time, the spout 110 is also raised, as shown in FIG. 1G. This is because the annular cap engagement protrusion 114 is in a state engaged with the annular protrusion 123 of the cap 120, that is, in a state fitted in the annular groove 122 of the cap 120.

In accordance with a continued rotation of the cap 120, the upward movement of the spout 110 is continued until the lower annular protrusion 112 of the spout 110 is fitted in the annular groove 102 of the body 100. This state is established before the lower end of the thread 125. formed on the cap 120 reaches the upper end of the thread 106*a* formed on the body 100. Accordingly, a further rotation of the. cap 120 results in a disengagement of the annular cap engagement protrusion 114 of the spout 110 from the annular protrusion 123 of the cap 120. This disengagement is elastically carried out as the annular cap engagement protrusion 114 passes over the annular protrusion 123 in a snapped fashion. Thus, the cap 120 is separated from the spout 110, as shown in FIG. 1H. As the cap 120 is further rotated, it can be separated from the spout assembly 10, as shown in FIG. 1I.

Figure 1F:
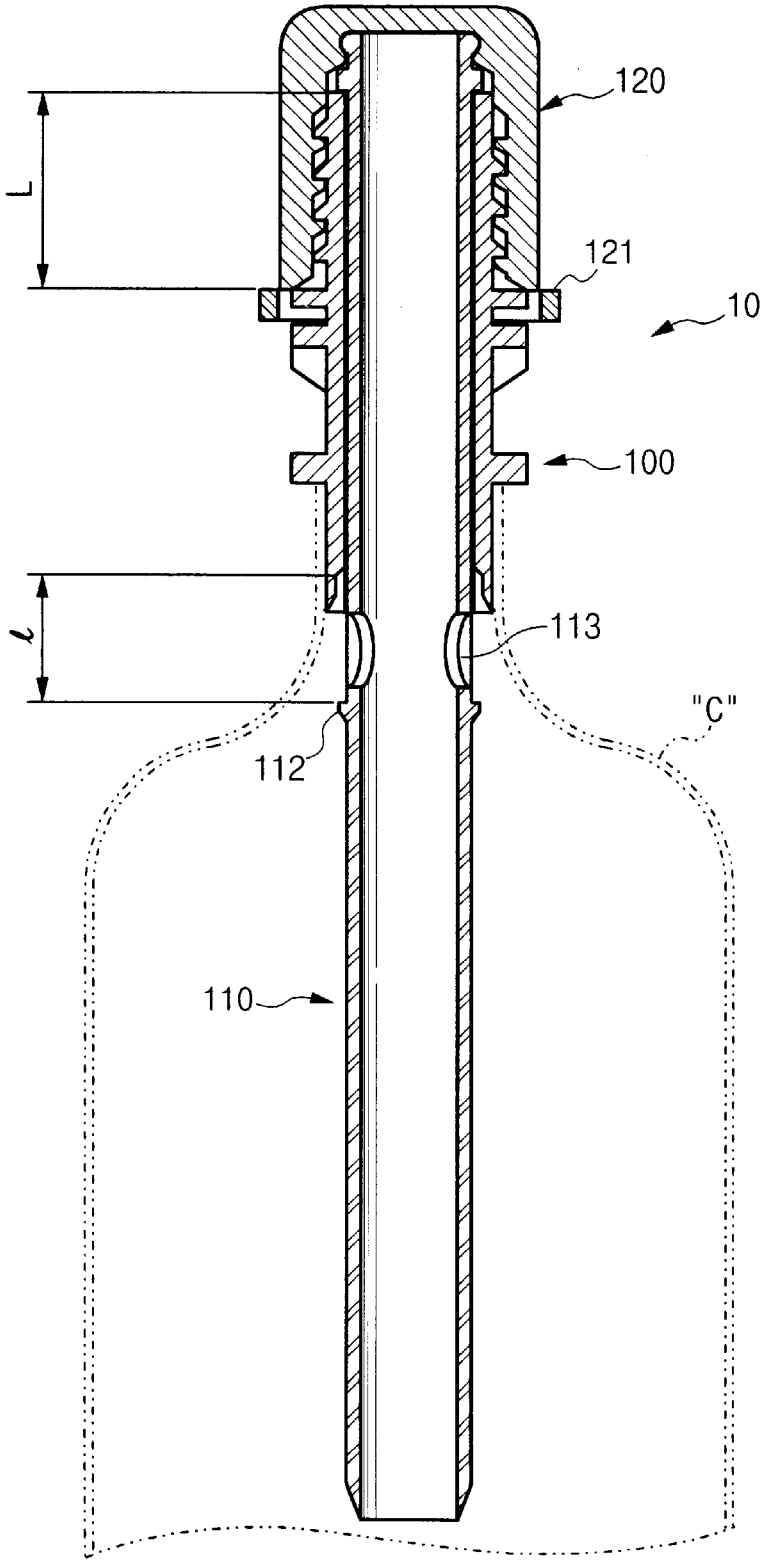
Figure 1G:
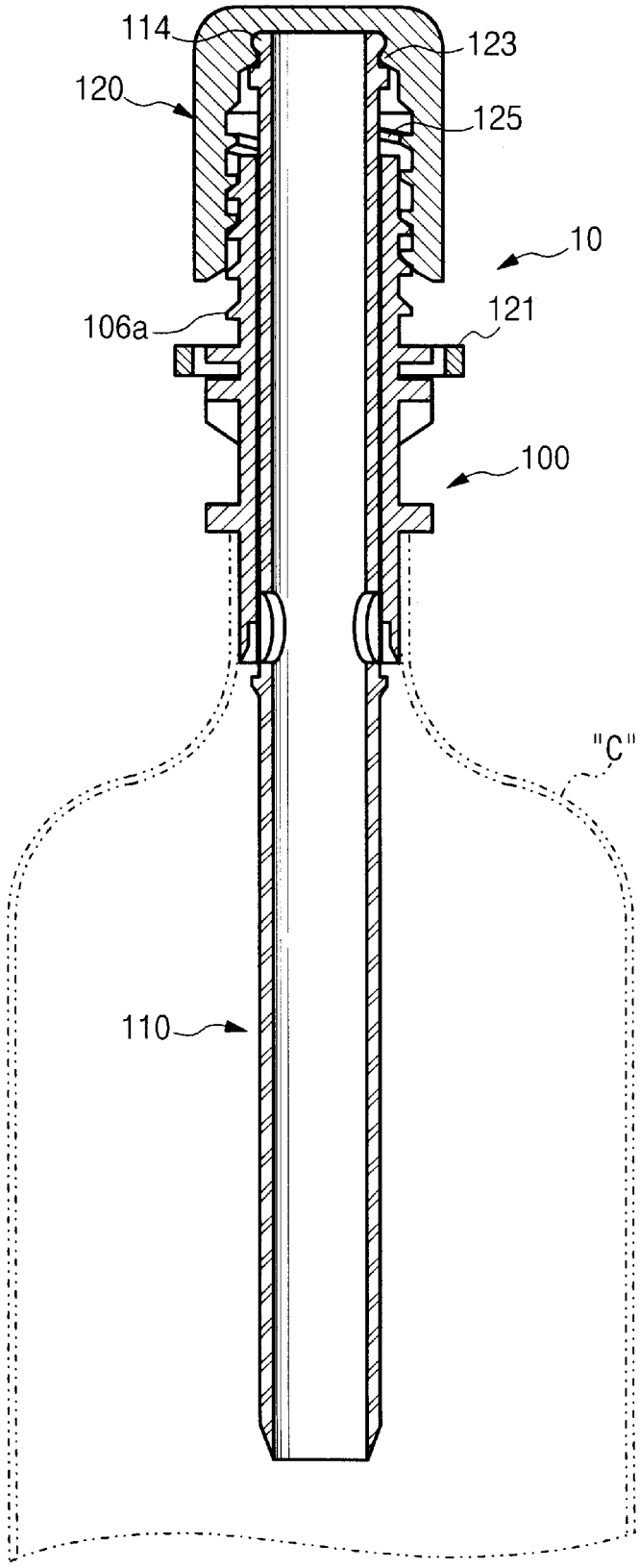
Figure 1H:
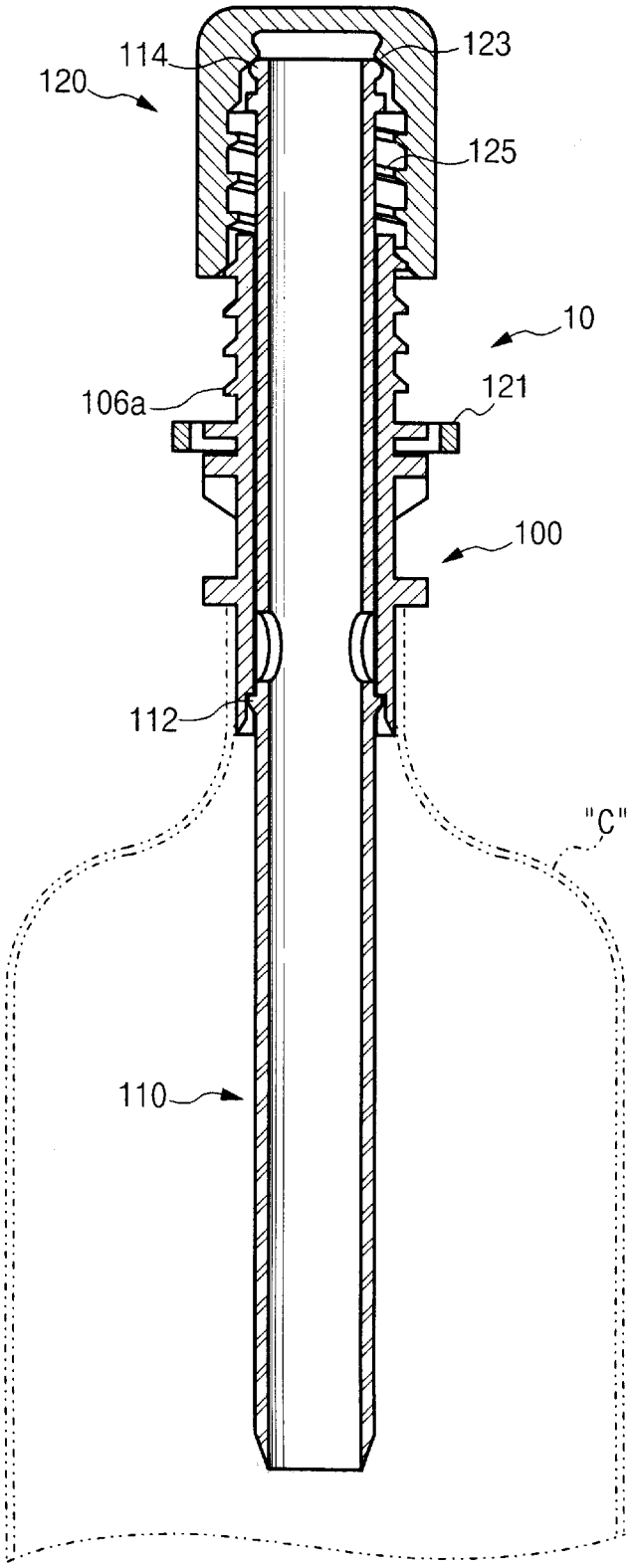
Figure 1I:
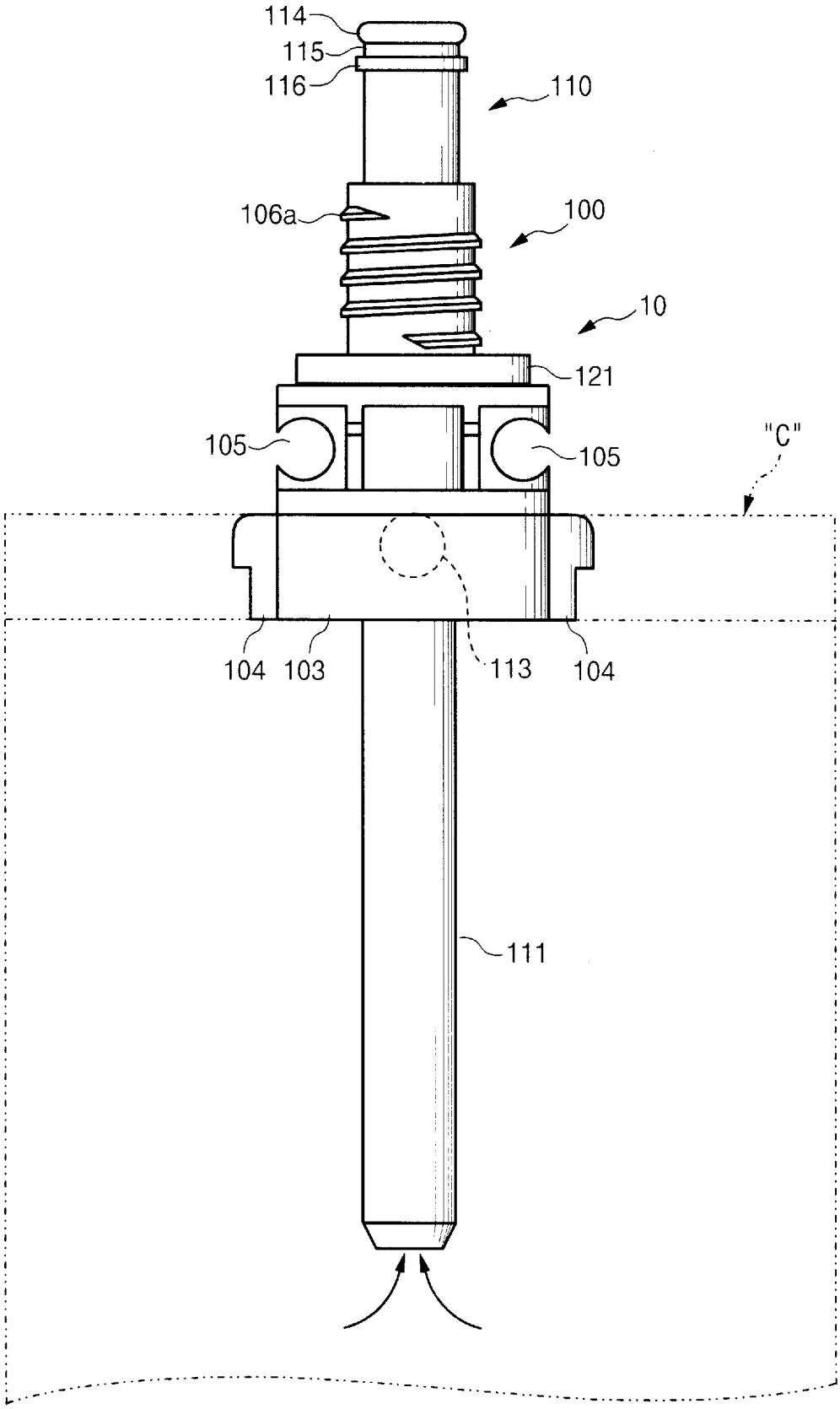

Referring to FIG. 1F, the stroke P of the spout 110 is less than the vertical length L of the thread 106*a* formed on the body 100. Accordingly, as the cap 120 is rotated to open the spout assembly 10, it is naturally separated from the spout 110 at the point when the vertical movement length thereof exceeds the stroke P of the spout 110.

The use of the opened spout assembly 10 to drink the liquid contained in the container C or to dispense the liquid to another container will now be described.

When the spout assembly 10 is opened as the cap 120 is separated therefrom, the spout 110 is in a raised state in which the lower annular protrusion 112 of the spout 110 is fitted in the annular groove 102 of the body 100. In the raised state of the spout 110, the through hole 113 is closed by the inner surface of the body 100 defining the vertical passage 101, as shown in FIG. 1I. In this state, when the user holds the upper end of the spout 110 by the mouth and conducts a sucking action, the liquid contained in the container C is introduced into the lower end of the liquid passage 117 defined in the spout 110 and then discharged into the mouth of the user via the liquid passage 117. During the discharge of the liquid, the container C is shrunk in proportion to the amount of liquid discharged through the liquid passage 117.

Figure 1J:
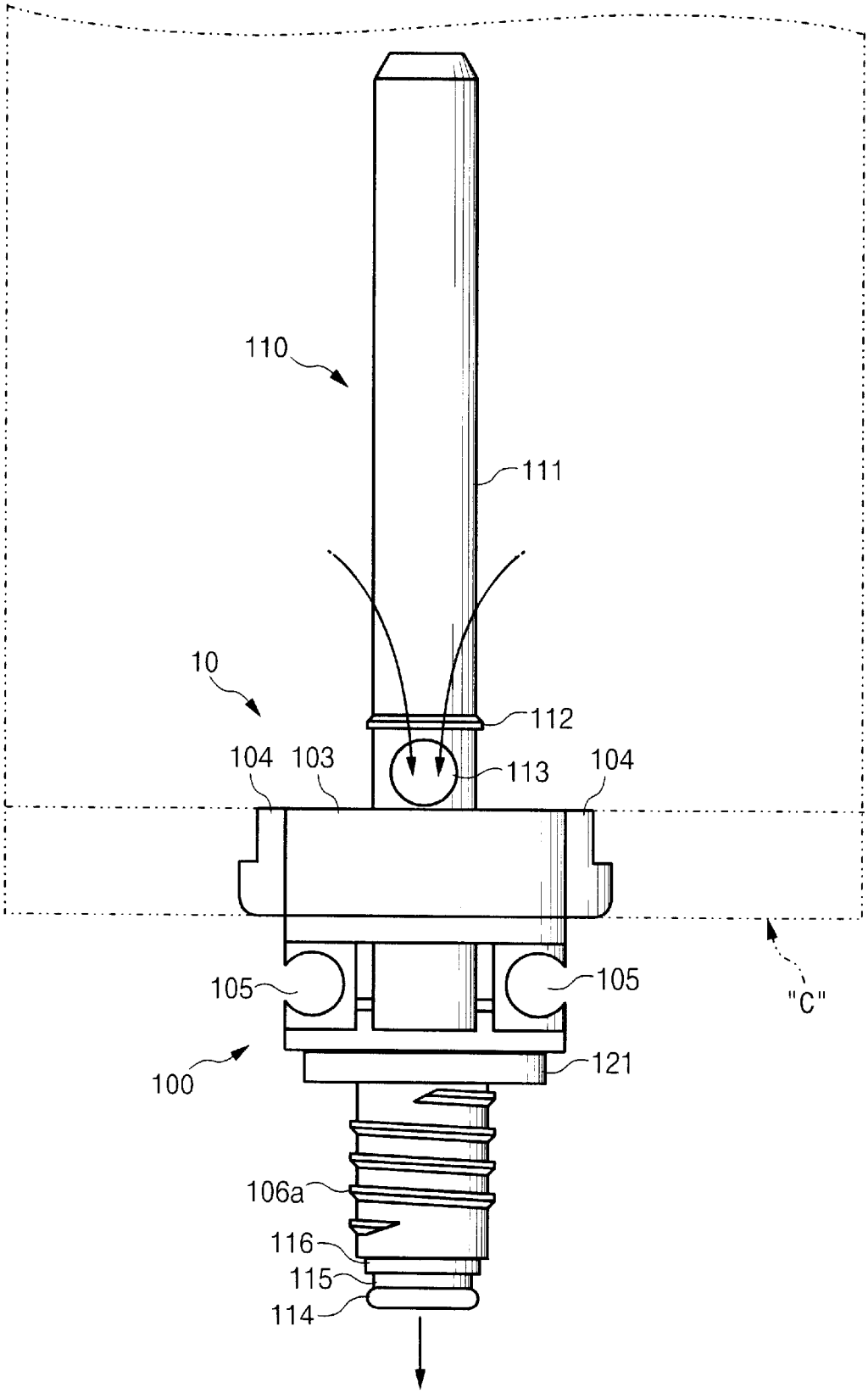

When it is desired to dispense the liquid from the container C to another container, the user depresses the upper end of the spout 110 from the state of FIG. 1I. Accordingly, the spout 110 moves downwardly as the lower annular protrusion 112 thereof is separated from the, annular groove 102 of the body 100. The downward movement of the spout 110 is stopped when the upper annular protrusion 116 comes into contact with the upper end of the body 100. In this state, the through hole 113 is exposed to the interior of the container C. When the container C is tilted in one direction, as shown in FIG. 1J, the liquid in the container C is introduced into the through hole 113 and then outwardly discharged through the liquid passage 117.

When the cap 120 is coupled and fastened to the spout assembly 10 in the state of FIG. 1I, the spout 110 is downwardly moved as the cap 120 is fastened. The downward movement of the spout 110 is stopped when the upper annular protrusion 116 thereof comes into contact with the upper end of the body 100, as shown in FIG. 1J. When the cap 120 is further fastened from this state, the annular protrusion 123 passes over the annular cap engagement protrusion 114 of the spout 110 and then engages with the annular groove 115 of the spout in a snapped fashion. That is, the annular cap engagement protrusion 114 of the spout 110 engages with the annular groove 122 of the cap 120. Accordingly, the cap 120 can be completely fastened to the spout assembly 10 in a state in which it is coupled to the spout 110. Therefore, the spout 110 can be upwardly moved when the cap 120 is rotated in a releasing direction in order to use again the spout assembly 10. Thus, the spout assembly 10 can be repeatedly used in accordance with the above mentioned operations.

Figure 2A:
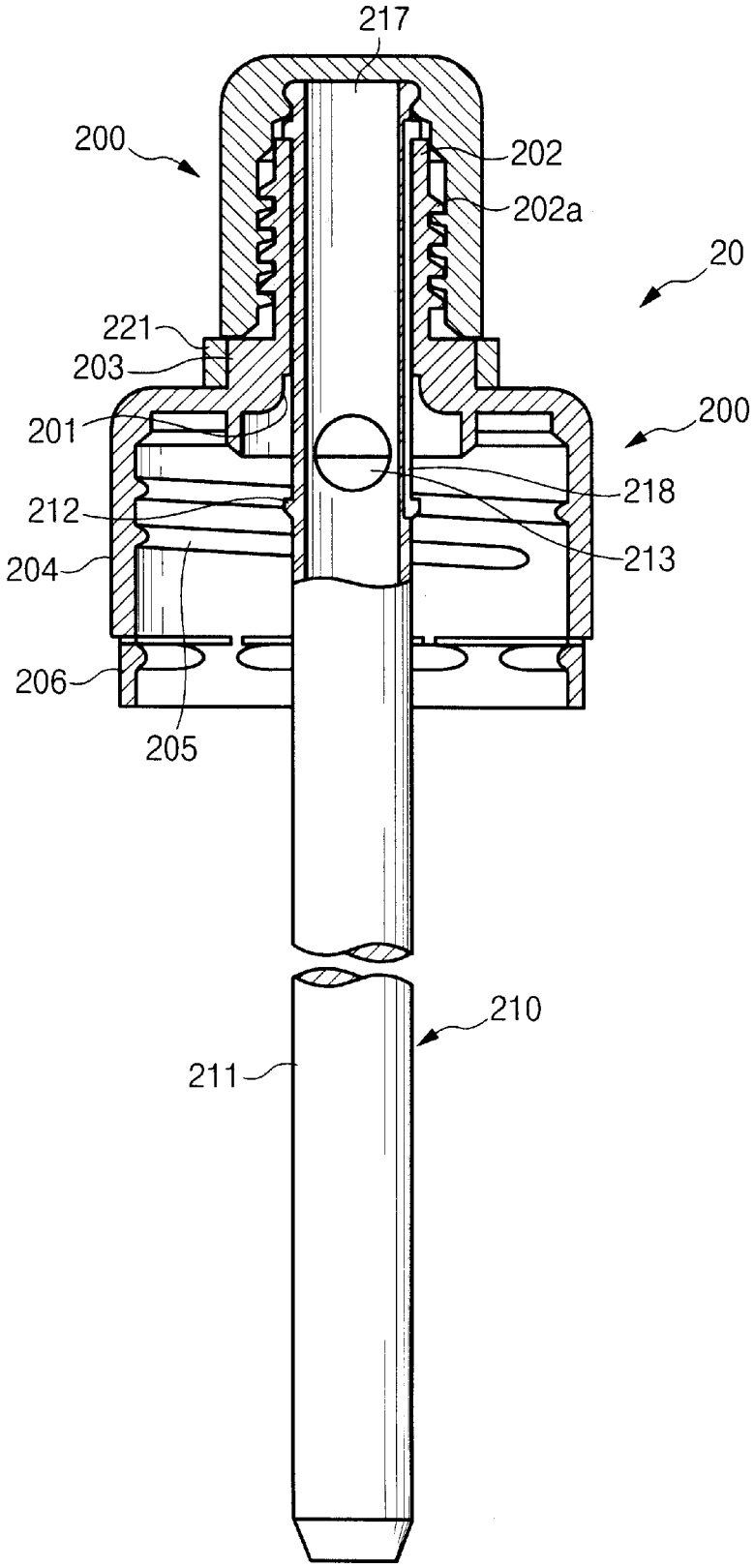
Figure 2B:
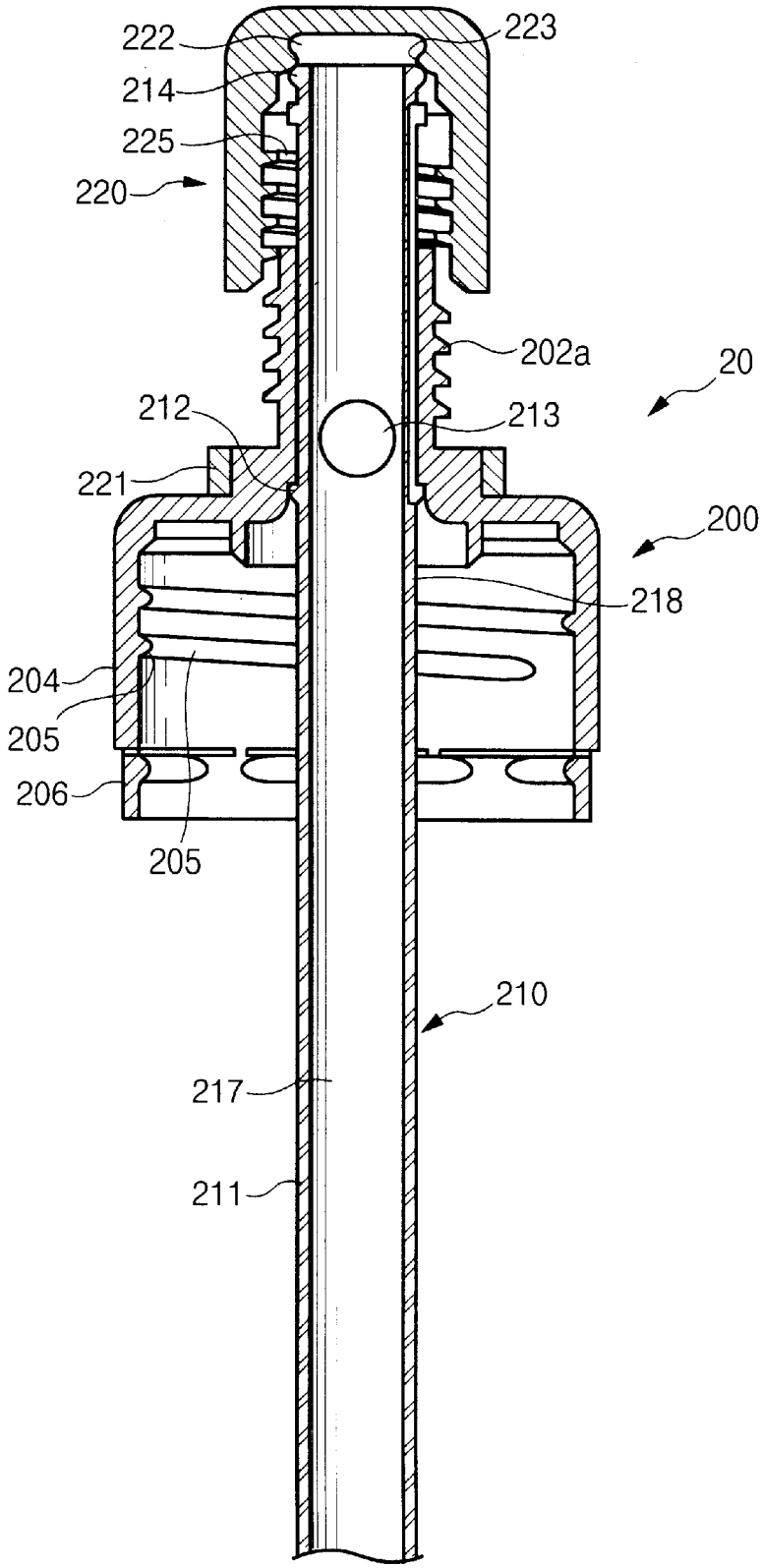
Figure 2C:
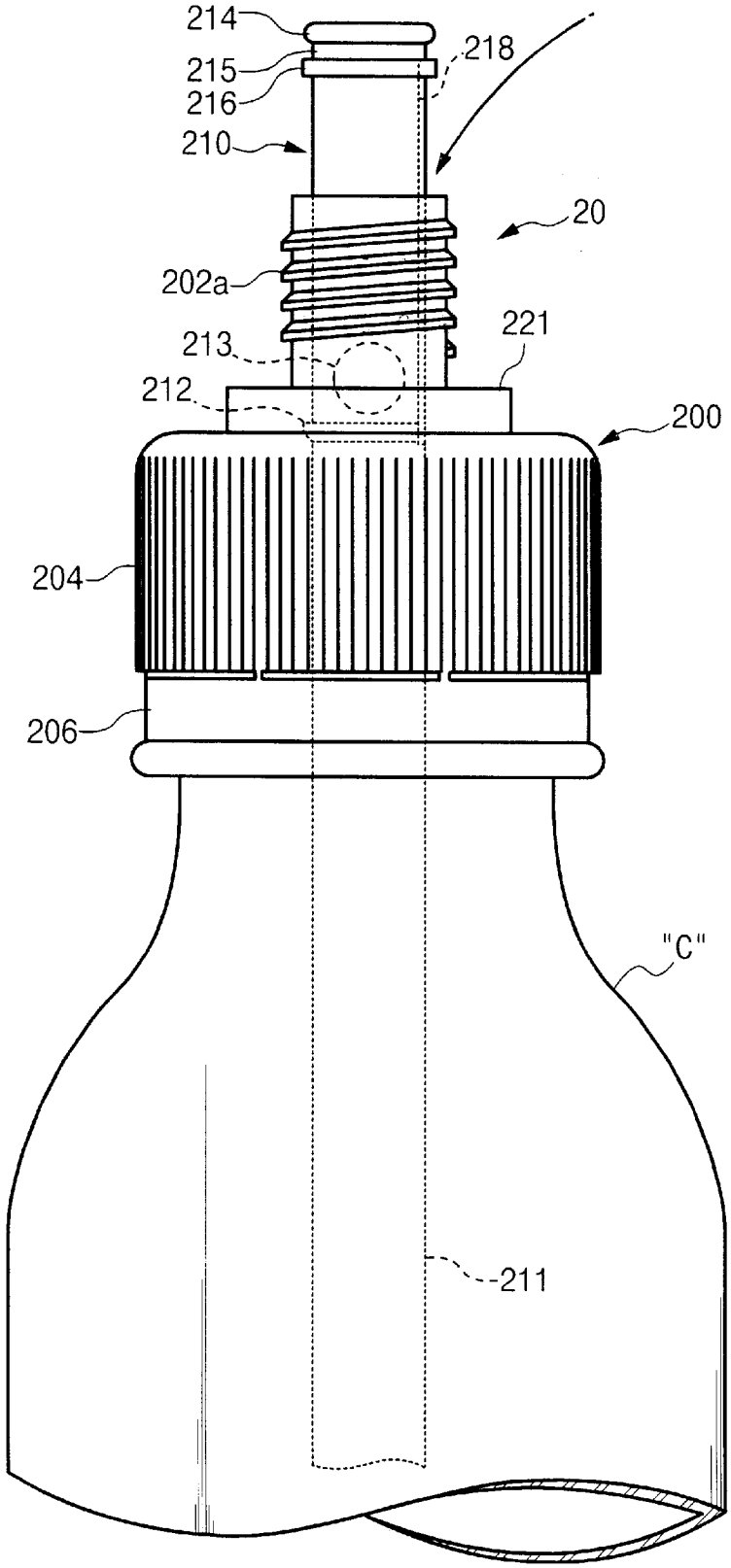

Referring to FIGS. 2A to 2C, a spout assembly according to a second embodiment of the present invention is illustrated. As shown in FIGS. 2A to 2C, the spout assembly, which is denoted by the reference numeral 20, includes a body 200, and a spout 210 inserted into the body 200 in such a fashion that it is slidable along the body 200. A cap 220 is threadedly coupled to the body 200. In a state coupled to the body 200, the cap 220 is also engaged with an upper end of the spout 210. The body 200 is centrally provided with a vertical passage extending vertically throughout the body 200 and serving to vertically receive the spout 210 while allowing the spout 210 to be slidable therealong. The vertical passage has an enlarged portion 201 at its lower end. The enlarged portion 201 of the vertical passage serves as an annular groove for receiving a lower annular protrusion 212 formed at a desired portion of the spout 210, thereby preventing the spout 210 from moving upwardly. The body 200 further has a cap coupling portion 202 at its upper portion. A thread 202*a* is formed around the cap coupling portion 202. A skirt engagement member 203 is formed at the lower end of the cap coupling portion 202 so that it is engagable with an opening identification skirt 221 included in the cap 220. The body 200 is also provided at its lower portion with a downwardly extending container coupling portion 204. The container coupling portion 204 is formed at its inner surface with a thread 205. An opening identification skirt 206 is provided at the lower end of the container coupling portion 204.

The spout 210 includes an elongated tube member 211 slidably inserted into the vertical passage of the body 200. The lower annular protrusion 212, which is adapted to be selectively fitted in the annular groove 201 of the body 200, is protruded from the outer surface of the elongated tube member 211 at a desired position. When the tube member 211 moves upwardly through the body 200 by a predetermined length, the lower annular protrusion 212 is tightly fitted in the annular groove 201 of the body 200, thereby preventing a further upward movement of the tube member 211. Above the lower annular protrusion 212, the tube member 211 has at least one through hole 213 radially perforated through the wall of the tube member 211. In a state in which the lower annular protrusion 212 is fitted in the annular groove 201 of the body 200, the through hole 213 is closed by the inner surface of the body 200 defining the vertical passage through which the tube member 211 extends. An annular cap engagement protrusion 214 is formed at the upper end of the tube member 211. Beneath the annular cap engagement protrusion 214, an upper annular protrusion 216 is formed at the tube member 211 while being vertically spaced from the annular cap engagement protrusion 214 to define an annular groove 215. When the tube member 211 moves downwardly through the body 200 by a predetermined length, the upper annular protrusion 216 comes into contact with the upper end of the body 200, thereby preventing a further downward movement of the tube member 211. A liquid passage 217 is defined in the tube member 211. The liquid passage 217 extends-vertically throughout the tube member 211 while communicating with the through hole 213. An air passage 218 is defined between the outer surface of the tube member 211 and the inner surface of the body 200 by a groove vertically formed on a portion of the outer surface of the tube member 211 not vertically aligned with the through hole 213. The air passage 218 extends vertically from the upper annular protrusion 216 to the lower annular protrusion 212 so that air is introduced into the interior of the container C via the air passage 218 when the cap 220 is separated from the body 200.

The cap 220, which is threadedly coupled to the thread 202*a* of the cap coupling portion 202 in the body 200, is provided at its lower end with the opening identification skirt 221, as mentioned above. The opening identification skirt 221 extends radially outwardly from the lower end of the cap 220 while being connected to the lower end of the cap 220 by bridges. The opening identification skirt 221 has, at its inner surface, an engagement portion adapted to engage with the skirt engagement member 203 of the body 200, so that it collapses when it is subjected to a force for opening the cap 220, thereby providing a visual appearance indicative of the opening of the cap 220. The cap 120 is also provided with an annular groove 222 at the inner surface of the top wall thereof and with an annular protrusion 223 at the inner surface of the side wall thereof. The annular groove 222 is engagable with the annular cap engagement protrusion 214 of the tube member 211 in a snapped fashion, and the annular protrusion 223 is engagable with the annular groove 215 of the tube member 211 in a snapped fashion. An annular contact surface 224 is provided at the inner surface of the side wall in the cap 220 beneath the annular protrusion 223. In a state in which the cap 220 engages with the tube member 211, the annular contact surface 224 is in tight contact with the upper annular protrusion 216 of the tube member 211, thereby sealing the liquid passage 217 of the tube member 211. Beneath the annular contact surface 224, the cap 220 has a thread 225 engagable with the thread 202*a* of the body 200.

Referring to FIG. 2A, an assembled state of the spout assembly 20 is illustrated. This spout assembly 20 is then threadedly coupled to the container C in a state in which a desired liquid is filled in the container C. The coupling of the spout assembly 20 to the container C can be achieved in a conventional manner using a conventional coupling machine. Referring to FIG. 2C, an initially coupled state of the spout assembly 20 to the container C is illustrated. In the initially coupled state of the spout assembly 20, the opening identification skirt 206 is engaged with a skirt engagement member (not shown) provided at the container C.

Now, the operation and effect of the spout assembly 20 upon dispensing the liquid from the container C will be described in conjunction with FIGS. 2A to 2C. When it is desired to dispense the liquid from the container C, the cap 220 is first rotated from the state of FIG. 2A so that it is released from the spout assembly 20. By this rotation of the cap 120, the annular cap engagement protrusion 214 passes over the annular protrusion 223 in a snapped fashion. Thus, the cap 220 is separated from the spout 210, as shown in FIG. 2B. As the cap 220 is further rotated, it can be separated from the spout assembly 20.

The state of the spout assembly 20, in which the cap 220 is separated from the body 200, is illustrated in FIG. 2C. When the spout assembly 20 is opened as the cap 120 is separated therefrom, as shown in FIG. 2C, the spout 210 is in a raised state in which the lower annular protrusion 212 of the spout 210 is fitted in the annular groove 201 of the body 200. In the raised state of the spout 210, the through hole 213 is closed by the inner surface of the body 200. In this state, when the user holds the upper end of the spout 210 by the mouth and conducts a sucking action, the liquid contained in the container C is introduced into the lower end of the liquid passage 217 defined in the spout 210 and then discharged into the mouth of the user via the liquid passage 217. When it is desired to dispense the liquid from the container C to another container, the user depresses the upper end of the spout 210 from the state of FIG. 2C. Accordingly, the spout 210 moves downwardly as the lower annular protrusion 212 thereof is separated from in the annular groove 201 of the body 200. The downward movement of the spout 210 is stopped when the upper annular protrusion 216 comes into contact with the upper end of the body 200. In this state, the through hole 213 is exposed to the interior of the container C. When the container C is tilted in one direction, the liquid in the container C is introduced into the through hole 213 and then outwardly discharged through the liquid passage 217. During the discharge of the liquid, air is introduced into the interior of the container C via the air passage 218 defined between the outer surface of the spout 210 and the inner surface of the body 200. Accordingly, the liquid from the container C can be easily discharged without any surge phenomenon.

Even when the user sucks the liquid from the container C, there is no shrinkage of the container C because air is introduced into the interior of the container C via the air passage 218. Although the spout assembly according to the first embodiment of the present invention has been described as being applied to a flexible container, it may also be applied to a non-flexible container such as a tube type container or a paper container made of a paper material exhibiting a certain hardness in so far as it is provided with an air passage defined between the outer surface of the spout and the inner surface of the body.

In accordance with the second embodiment of the present invention, the process of filling a liquid in the container C may be carried out under the condition in which the spout assembly 20, to which the cap 220 is not coupled yet, is coupled to the container C. In this case, the liquid is filled in the container C through the liquid passage 217. After the completion of the liquid filling process, the cap 220 is finally coupled to the spout assembly 20.

Figure 3:
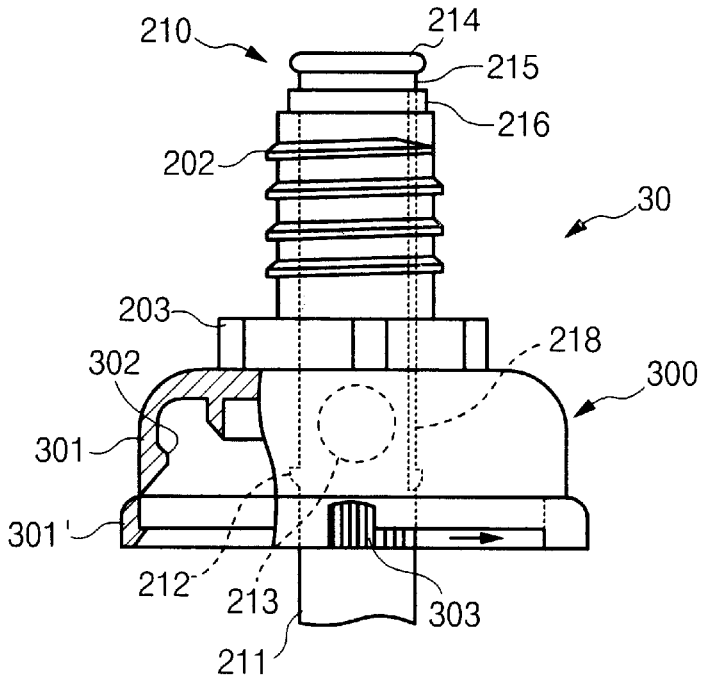
FIGS. 3 to 5 are partially-broken front views respectively illustrating modified configuration of the spout assembly according to the second embodiment of the present invention.

FIG. 3 illustrates a modified configuration of the spout assembly 20 according to the second embodiment of the present invention. The configuration shown in FIG. 3 is similar to that of FIG. 2A, except for the means for coupling the spout assembly to the container C. As shown in FIG. 3, the spout assembly, which is denoted by the reference numeral 30 includes a body 300 provided with a container coupling means comprising a skirt 301 extending radially outwardly and downwardly from the lower end of the body 400. The skirt 301 is provided at its lower end with an engagement jaw 302. The container coupling means may also comprise another skirt 301' extending downwardly from the lower end of the skirt 301. If necessary, a pull knob 303 may be provided at the skirt 301' in order to collapse the skirt 301', thereby allowing the spout assembly 30 to be easily separated from the container C.

Figure 4:
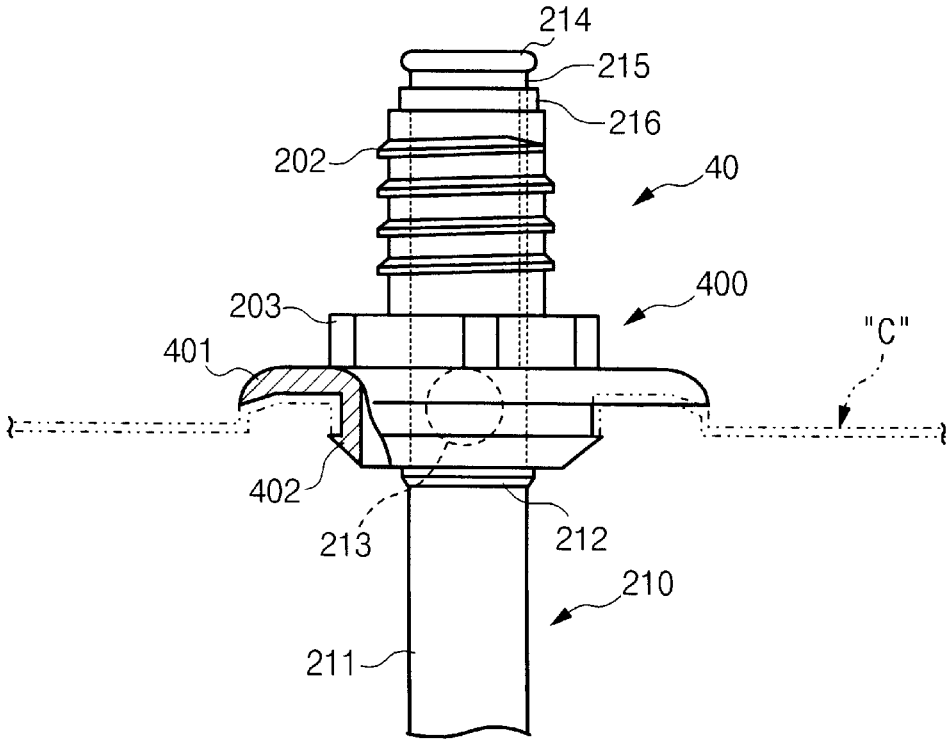

FIG. 4 illustrates another modified configuration of the spout assembly 20 according to the second embodiment of the present invention. The configuration shown in FIG. 4 is similar to that of FIG. 2A, except for the means for coupling the spout assembly to the container C. As shown in FIG. 4, the spout assembly, which is denoted by the, reference numeral 40 includes a body 400 provided with a container coupling means comprising an annular flange 401 extending radially outwardly from the lower end of the body 400. A downward extension, which has an engagement jaw 402 at its lower end, extends downwardly from the inner end of the annular flange 401. When the spout assembly 40 is to be coupled to the container C, the engagement jaw 402 is vertically aligned with the opening of the container C. In this state, as the spout assembly 40 moves downwardly, the engagement jaw 402 passes over the upper end of the container C defining the container opening and then engages with the upper end of the container C in a snapped fashion, as shown in FIG. 4.

Figure 5:
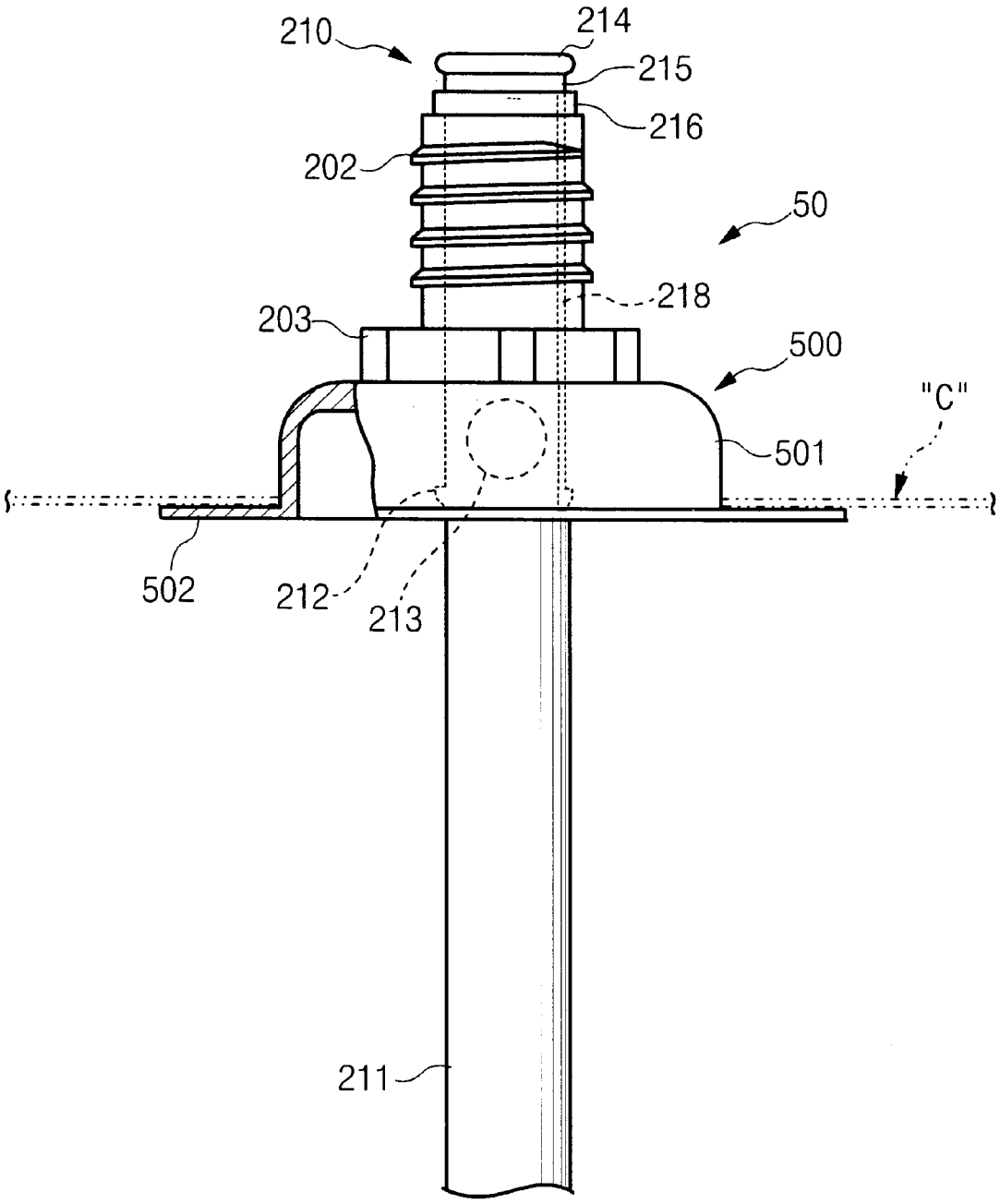

Also, FIG. 5 illustrates another modified configuration of the spout assembly 20 according to the second embodiment of the present invention. The configuration shown in FIG. 5 is similar to that of FIG. 2A, except for the means for coupling the spout assembly to the container C. As shown in FIG. 5, the spout assembly, which is denoted by the reference numeral 50 includes a body 500 provided with a container coupling means comprising a skirt extending radially outwardly and downwardly from the lower end of the body 400 while being provided at its lower end with an annular bonding flange 502 in order to allow the user to easily hold the spout assembly 50 upon opening or closing the spout assembly 50. When this spout assembly 50 is to be coupled to the container C, a process is carried out to make the annular bonding flange 502 come into contact with the lower surface of the portion of the container C around the container opening. In this state, the annular bonding flange 502 is bonded to the contact portion of the container C in accordance with a thermal bonding method.

Since the remaining configuration of the spout assembly, in particular, the configuration of the cap, in FIGS. 3 to 5 is identical to that of FIG. 2A, it is omitted from FIGS. 3 to 5.

Figure 6A:
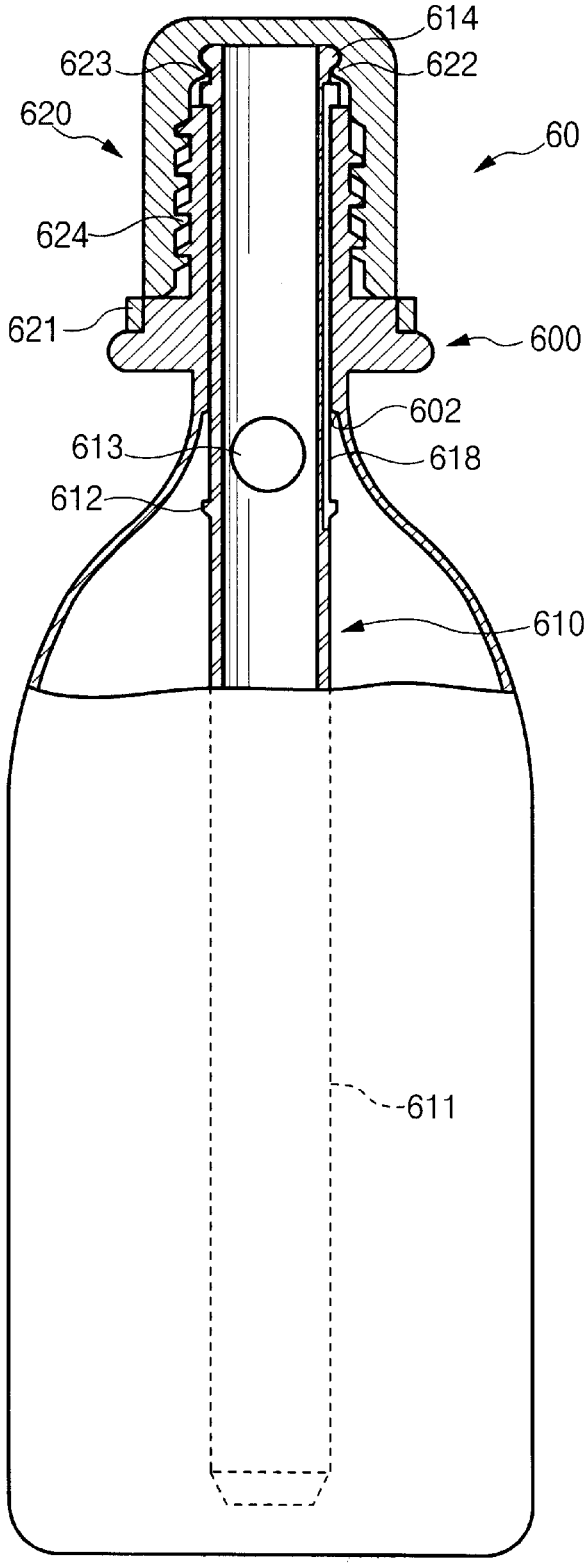
Figure 6B:
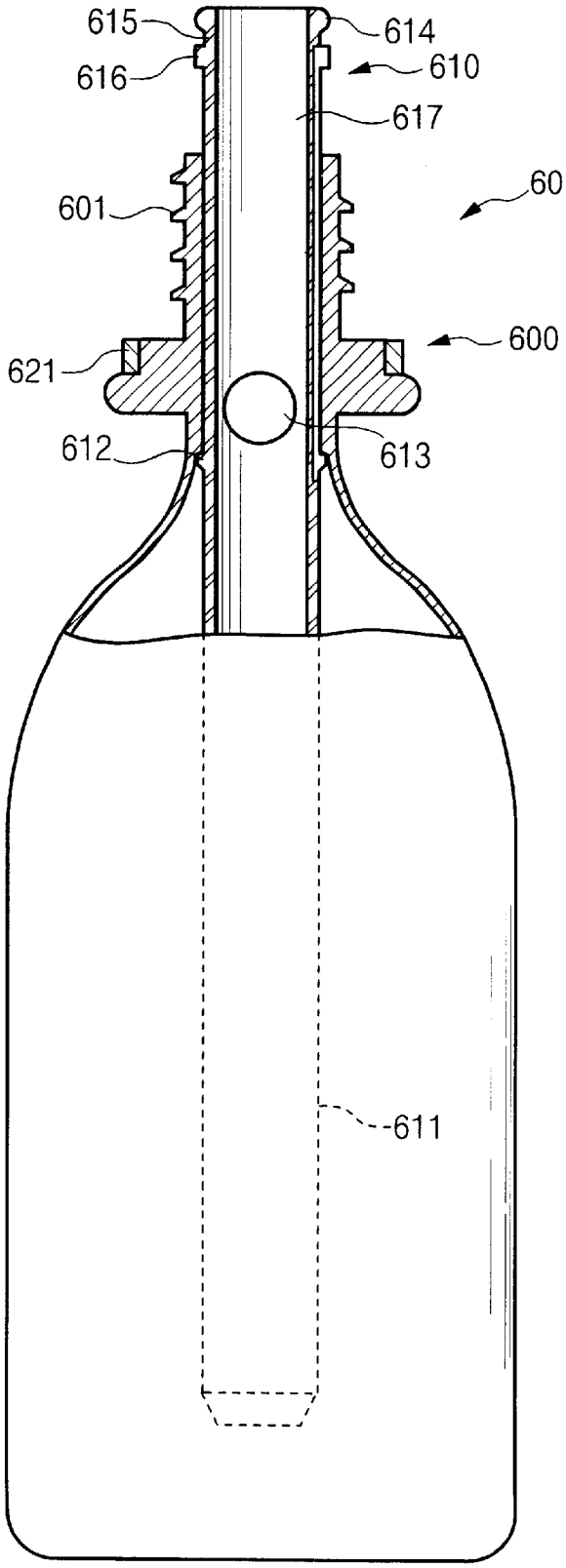
Figure 6C:
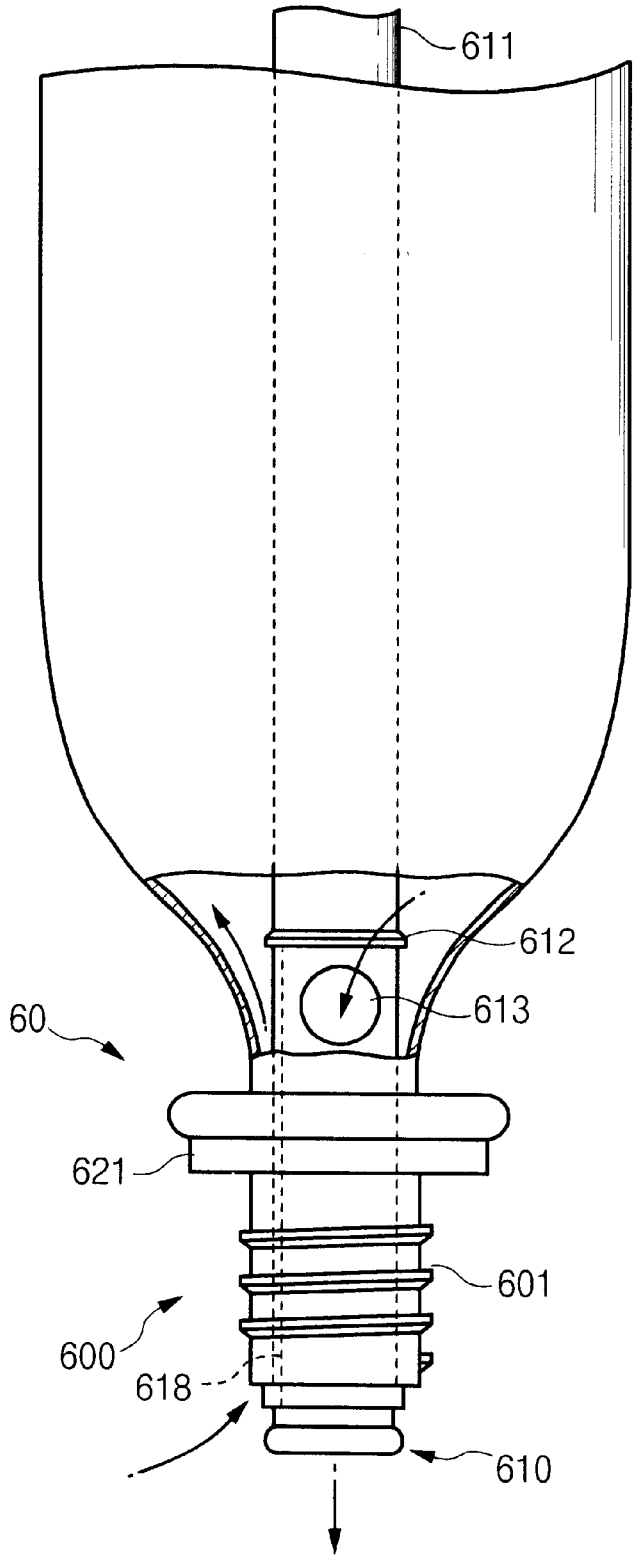

Referring to FIGS. 6A to 6C, a spout assembly according to a third embodiment of the present invention is illustrated. In accordance with this embodiment, the spout assembly is integrally formed with the upper end of the container, namely, the neck of the container. This embodiment has the same basic concept as those of the above mentioned embodiments. This embodiment is mainly different from the above mentioned embodiments in that it can be applied to a container having a narrow neck without any modification in the neck shape of the container. In accordance with this embodiment, the spout assembly, which is denoted by the reference numeral 60, includes a body 600 having a bottle shape to contain a desired liquid therein. The body 600 has a neck portion at its upper portion and a bottle portion at its lower portion. A thread 601 is formed on the outer surface of the neck portion in the body 600. The spout assembly 60 also includes a spout 610 inserted into the body 600 in such a fashion that it is slidable along the body 600. A cap 620 is threadedly coupled to the neck portion of the body 600. In a state coupled to the body 600, the cap 620 is also engaged with an upper end of the spout 610. The body 600 is centrally provided with a vertical passage extending vertically throughout the neck portion of the body 600 and serving to vertically receive the spout 610. while allowing the spout 610 to be slidable therealong. An annular groove 602 is formed on the inner surface of the body 600 beneath the neck portion in order to receiving a lower annular protrusion 612 formed at a desired portion of the spout 610, thereby preventing the spout 610 from moving upwardly.

The spout 610 includes an elongated tube member 611 slidably inserted into the vertical passage of the body 600. The lower annular protrusion 612, which is adapted to be selectively fitted in the annular groove 602 of the body 600, is protruded from the outer surface of the elongated tube member 611 at a desired position. When the tube member 611 moves upwardly through the body 600 by a predetermined length, the lower annular protrusion 612 is tightly fitted in the annular groove 602 of the body 600, thereby preventing a further upward movement of the tube member 611. Above the lower annular protrusion 612, the tube member 611 has at least one through hole 613 radially perforated through the wall of the tube member 611. In a state in which the lower annular protrusion 612 is fitted in the annular groove 602 of the body 600, the through hole 613 is closed by the inner surface of the body 600 at the neck portion. An annular cap engagement protrusion 614 is formed at the upper end of the tube member 611. Beneath the annular cap engagement protrusion 614, an upper annular protrusion 616 is formed at the tube member 611 while being vertically spaced from the annular cap engagement protrusion 614 to define an annular groove 615. When the tube member 611 moves downwardly through the body 600 by a predetermined length, the upper annular protrusion 616 comes into contact with the upper end of the body 600, thereby preventing a further downward movement of the tube member 611. A liquid passage 617 is defined in the tube member 611. The liquid passage 617 extends vertically throughout the tube member 611 while communicating with the through hole 613. An air passage 618 is defined between the outer surface of the tube member 611 and the inner surface of the body 600 at the neck portion by a groove vertically formed on a portion of the outer surface of the tube member 611 not vertically aligned with the through hole 613.

The cap 620, which is threadedly coupled to the thread 601 of the neck portion in the body 600, is provided at its lower end with an opening identification skirt 621. The opening identification skirt 621 extends radially outwardly from the lower end of the cap 620 while being connected to the lower end of the cap 620 by bridges. The opening identification skirt 621 has, at its inner surface, an engagement portion adapted to engage with a skirt engagement member of the body 600, so that it collapses when it is subjected to a force for opening the cap 620, thereby providing a visual appearance indicative of the opening of the cap 620. The cap 620 is also provided with an annular protrusion 622 at the inner surface of the side wall thereof to define an annular groove thereover. The annular protrusion 622 is engagable with the annular cap engagement protrusion 214 and annular groove 615 of the tube member 611 in a snapped fashion. An annular contact surface 623 is provided at the inner surface of the side wall in the cap 620 beneath the annular protrusion 622. In a state in which the cap 620 engages with the tube member 611, the annular contact surface 623 is in tight contact with the upper annular protrusion 616 of the tube member 611, thereby sealing the liquid passage 617 of the tube member 611. Beneath the annular contact surface 623, the cap 620 has a thread 624 engagable with the thread 601 of the body 600.

The process for filling a desired liquid in the body 600 may be carried out before or after assembling the spout 610 to the body 600. After the completion of the liquid filling process, the cap 620 is finally threadedly coupled to the body 600.

Now, the operation and effect of the spout assembly 60 upon dispensing the liquid from the body 600 will be described in conjunction with FIGS. 6A to 6C. When it is desired to dispense the liquid from the body 600, the cap 620 is first rotated from the state of FIG. 6A so that it is released from the spout assembly 60. Accordingly, the cap 120 is raised in accordance with a cooperation of the threads 601 and 624 until the lower annular protrusion 612 of the spout 610 is fitted in the annular groove 602 of the body 600. In this state, a further rotation of the cap 620 results in a disengagement of the annular cap engagement protrusion 614 of the spout 610 from the annular protrusion 622 of the cap 620. This disengagement is elastically carried out as the annular cap engagement protrusion 614 passes over the annular protrusion 622 in a snapped fashion. Thus, the cap 620 is separated from the spout 610. As the cap 620 is further rotated, it can be separated from the spout assembly 60, as shown in FIG. 6B. In this state, when the user holds the upper end of the spout 610 by the mouth and conducts a sucking action, the liquid contained in the body 600 is introduced into the lower end of the liquid passage 617 defined in the spout 610 and then discharged into the mouth of the user via the liquid passage 617. When it is desired to dispense the liquid from the body 600 to another container, the user depresses the upper end of the spout 610 from the state of FIG. 6B. Accordingly, the spout 610 moves downwardly as the lower annular protrusion 612 thereof is separated from in the annular groove 602 of the body 200. The downward movement of the spout 610 is stopped when the upper annular protrusion 616 comes into contact with the upper end of the body 600. In this state, the through hole 613 is exposed to the interior of the body 600. When the body 600 is tilted in one direction, the liquid in the body 600 is introduced into the through hole 613 and then outwardly discharged through the liquid passage 617. During the discharge of the liquid, air is introduced into the interior of the body 600 via the air passage 618 defined between the outer surface of the spout 610 and the inner surface of the body 600.

INDUSTRIAL APPLICABILITY

As apparent from the above description, the present invention provides a spout assembly designed to be applied to a variety of containers, such as flexible pouches and non-flexible containers, while being capable of not only achieving an easy filling of a liquid beverage in a container, to which the spout assembly is applied, but also allowing the user to easily and conveniently drink the filled liquid beverage.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

For instance, a configuration may be implemented in which the spout is not raised by an upward movement of the cap, but raised by a raising action of the user in a state in which he grips the upper end of the spout using the fingers. In this case, accordingly, it is unnecessary to provide, at the cap, the annular protrusion adapted to raise the spout.

What is claimed is:

1. A spout assembly for a liquid container comprising:

a body centrally provided with a vertical passage extending vertically throughout said body, said body including an annular groove formed at a lower end of said vertical passage, a primary container bonding portion provided at a lower portion of said body, said primary container bonding portion extending around said vertical passage while extending laterally in a reduced thickness at opposite sides of said vertical passage, a secondary container bonding portion formed at said lower portion of said body over said primary container bonding portion, said secondary container bonding portion extending laterally beyond said primary container bonding portion, a cap coupling portion provided at an upper portion of said body, a thread formed around said cap coupling portion, a skirt engagement member formed at a lower end of said cap coupling portion, and a pair of opposite alignment grooves provided at an intermediate portion of said body;

a spout inserted into said vertical passage of said body in such a fashion that it is slidable along said vertical passage, said spout including an elongated tube member slidably inserted into said vertical passage of said body, a lower annular protrusion protruded from an outer surface of said elongated tube member at a desired position and adapted to be selectively fitted in said annular groove of said body, at least one through hole radially perforated through said tube member above said lower annular protrusion, said through hole being closed by an inner surface of said body defining said vertical passage when said lower annular protrusion is fitted in said annular groove of said body; an annular cap engagement protrusion formed at an upper end of said tube member, an upper annular protrusion formed at said tube member while being vertically spaced from said annular cap engagement protrusion to define an annular groove, and a liquid passage defined in said tube member, said liquid passage extending vertically throughout said tube member while communicating with said through hole; and a cap threadedly coupled to said thread of said cap coupling portion in said body, said cap including a cap body, an opening identification skirt provided at a lower end of said cap body and engaged with said skirt engagement member of said body, an annular groove formed at an inner surface of a top wall of said cap body, said annular groove being engagable with said annular cap engagement protrusion of said tube member in a snapped fashion, an annular protrusion formed at an inner surface of a side wall of said cap body, said annular protrusion being engagable with said annular groove of said tube member in a snapped fashion, an annular contact surface provided at said inner surface of said side wall of said cap body beneath said annular protrusion, said annular contact surface being in tight contact with said upper annular protrusion of said tube member in a state in which said cap engages with said tube member, and a thread formed on said inner surface of said cap body beneath said annular contact surface and adapted to be engagable with said thread of said body.

2. The spout assembly as claimed in claim 1, wherein said spout further comprises:

a groove vertically formed on a portion of said outer surface of said tube member not vertically aligned with said through hole, said groove defining an air passage between said outer surface of said tube member and said inner surface of said body, said air passage extending vertically from said upper annular protrusion to said lower annular protrusion so that air is introduced into the interior of said container via said air passage when said cap is separated from said body.

3. A spout assembly for a liquid container comprising:

a body centrally provided with a vertical passage extending vertically throughout said body, said body including an annular groove formed at a lower end of said vertical passage, a cap coupling portion provided at an upper portion of said body, a thread formed around said cap coupling portion, a skirt engagement member formed at a lower end of said cap coupling portion, a container coupling portion provided at a lower portion of said body to extend downwardly and formed at an inner surface thereof with a thread, and an opening identification skirt provided at a lower end of said container coupling portion, a spout inserted into said vertical passage of said body in such a fashion that it is slidable along said vertical passage, said spout including an elongated tube member slidably inserted into said vertical passage of said body, a lower annular protrusion protruded from an outer surface of said elongated tube member at a desired position and adapted to be selectively fitted in said annular groove of said body, at least one through hole radially perforated through said tube member above said lower annular protrusion, said through hole being closed by an inner surface of said body defining said vertical passage when said lower annular protrusion is fitted in said annular groove of said body, an annular cap, engagement protrusion formed at an upper end of said tube member, an upper annular protrusion formed at said tube member while being vertically spaced from said annular cap engagement protrusion to define an annular groove, a liquid passage defined in said tube member, said liquid, passage extending vertically throughout said tube member while communicating with said through hole, and a groove vertically formed on a portion of said outer surface of said tube member not vertically aligned with said through hole, said groove defining an air passage between said outer surface of said tube member and said inner surface of said body, said air passage extending vertically from said upper annular protrusion to said lower annular protrusion so that air is introduced into the interior of said container via said air passage when said cap is separated from said body; and a cap threadedly coupled to said thread of said cap coupling portion in said body, said cap including a cap body, an opening identification skirt provided at a lower end of said cap body and engaged with said skirt engagement member of said body, an annular groove formed at an inner surface of a top wall of said cap body, said annular groove being engagable with said annular cap engagement protrusion of said tube member in a snapped fashion, an annular protrusion formed at an inner surface of a side wall of said cap body, said annular protrusion being engagable with said annular groove of said tube member in a snapped fashion, an annular contact surface provided at said inner surface of said side wall of said cap body beneath said annular protrusion, said annular contact surface being in tight contact with said upper annular protrusion of said tube member in a state in which said cap engages with said tube member, and a thread formed on said inner surface of said cap body beneath said annular contact surface and adapted to be engagable with said thread of said body.

4. The spout assembly as claimed in claim 3, wherein said body includes, in place of said container coupling portion, a container coupling means comprising a first skirt extending radially outwardly and downwardly from said lower end of said body, said first skirt being provided at a lower end thereof with an engagement jaw, and a second skirt extending downwardly from a lower end of said first skirt, said second skirt having a pull knob adapted to collapse said second skirt, thereby allowing said spout assembly to be easily separated from said container.

5. The spout assembly as claimed in claim 3, wherein said body includes, in place of said container coupling portion, a container coupling means comprising an annular flange extending radially outwardly from said lower end of said body, a downward extension extending downwardly from an inner end of said annular flange and having an elastic engagement jaw at a lower end thereof.

6. The spout assembly as claimed in claim 3, wherein said body includes, in place of said container coupling portion, a container coupling means comprising a skirt extending radially outwardly and downwardly from said lower end of said body, said skirt being provided at a lower end thereof with an annular bonding flange adapted to be bonded to a lower surface of a portion of said container around an opening of said container.

7. A spout assembly for a liquid container comprising:

a body having a bottle shape to contain a desired liquid therein, said body having a neck portion at an upper portion thereof and a bottle portion at a lower portion thereof, said body including a thread formed on an outer surface of said neck portion, a vertical passage extending vertically throughout said neck portion and communicating with the interior of said bottle portion, and an annular groove formed on an inner surface of said, body beneath said neck portion;

a spout inserted into said vertical passage of said body in such a fashion that it is slidable along said body, said spout including an elongated tube member slidably inserted into said vertical passage of said body, a lower annular protrusion protruded from an outer surface of said elongated tube member at a desired position and adapted to be selectively fitted in said annular groove of said body, at least one through hole radially perforated through said tube member above said lower annular protrusion, said through hole being closed by an inner surface of said neck portion when said lower annular protrusion is fitted in said annular groove of said body, an annular cap engagement protrusion formed at an upper end of said tube member, an upper annular protrusion formed at said tube member while being vertically spaced from said annular cap engagement protrusion to define an annular groove, a liquid passage defined in said tube member, said liquid passage extending vertically throughout said tube member while communicating with said through hole, and a groove vertically formed on a portion of said outer surface of said tube member not vertically aligned with said through hole, said groove defining an air passage between said outer surface of said tube member and said inner surface of said body, said air passage extending vertically from said upper annular protrusion to said lower annular protrusion; and a cap threadedly coupled to said thread of said cap coupling portion in said body, said cap including a cap body, an opening identification skirt provided at a lower end of said cap body and engaged with said skirt engagement member of said body, an annular groove formed at an inner surface of a top wall of said cap body, said annular groove being engagable with said annular cap engagement protrusion of said tube member in a snapped fashion, an annular protrusion formed at an inner surface of a side wall of said cap body, said annular protrusion being engagable with said annular groove of said tube member in a snapped fashion, an annular contact surface provided at said inner surface of said side wall of said cap body beneath said annular protrusion, said annular contact surface being in tight contact with said upper annular protrusion of said tube member in a state in which said cap engages with said tube member, and a thread formed on said inner surface of said cap body beneath said annular contact surface and adapted to be engagable with said thread of said body.

8. The spout assembly as claimed in any one of claims 1 to 7, wherein said annular protrusion of said cap adapted to raise said spout is eliminated so that said spout is not raised by an upward movement of said cap, but raised by a raising action of a user in a state in which he grips said upper end of said spout using the fingers.

9. A spout assembly for a liquid container comprising:

a body centrally provided with a vertical passage extending vertically throughout the body;

a tube-shaped spout inserted into said vertical passage of the body such that it is slidable along said vertical passage, a top of the spout being placed out of a top of the body and a bottom of the spout being placed within the liquid container; and a cap for covering the top of the body and the top of the spout, wherein the tube-shaped spout is provided with at least one through hole which is designed to be selectively closed by an inner surface of the body defining the vertical passage according to a sliding movement of the spout along the vertical passage, an upper annular cap engagement protrusion formed at its upper end so as to be engaged with an engaging groove formed in the cap, and a lower annular protrusion designed to be selectively engaged with an annular groove formed in the body to provide releasing force when releasing the upper engaging protrusion from the engaging groove formed in the cap.

10. A spout assembly of claim 9 wherein the body includes a primary container bonding portion provided at a lower portion of the body, the primary container bonding portion extending around the vertical passage while extending radially in a reduced thickness at opposite sides of the vertical passage, a secondary container bonding portion formed at the lower portion of the body over the primary container bonding portion, a thread formed to be screw-coupled with a cap thread, a skirt engagement member formed at a lower end of the cap thread, and a pair of opposite alignment grooves provided at an intermediate portion of the body.

11. A spout assembly of claim 9 wherein the tube-shaped spout further includes an annular protrusion formed at a lower portion of the annular cap engagement protrusion, the annular protrusion tightly contacting the top of the body when the cap is closed, and an air hole formed between the annular protrusion and the annular cap engagement protrusion to provide air into the container when the cap is open.

12. A spout assembly of claim 9 wherein the tube-shaped spout further includes a vertical air passage formed on its outer surface in a vertical direction to supply air into the container when the cap is open.

13. A spout assembly of claim 9 wherein the body further includes container coupling means comprising a first skirt extending radially outwardly and downwardly from the lower end of the body, the first skirt being provided at a lower end thereof with an engagement jaw, and a second skirt extending downwardly from a lower end of the first skirt, the second skirt having a pull knob adapted to collapse the second skirt, thereby allowing the spout assembly to be easily separated from the container.

14. A spout assembly of claim 9 wherein the body further includes a container coupling means comprising an annular flange extending radially outwardly from the lower end of the body, a downward extension extending downwardly from an inner end of the annular flange and having an elastic engagement jaw at a lower end thereof.

15. A spout assembly of claim 9 wherein the body further includes a container coupling means comprising a skirt extending radially outwardly and downwardly from the lower end of the body, the skirt being provided at a lower end thereof with an annular bonding flange adapted to be bonded to a lower surface of a portion of the container around a opening of the container.

* * * * *